US006997677B2

(12) United States Patent
Munshi et al.

(10) Patent No.: US 6,997,677 B2
(45) Date of Patent: Feb. 14, 2006

(54) METHOD AND APPARATUS FOR ROTATING MACHINE MAIN FIT SEAL

(75) Inventors: Jonathan Munshi, Scotia, NY (US); Bernard Arthur Couture, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 143 days.

(21) Appl. No.: 10/248,956

(22) Filed: Mar. 5, 2003

(65) Prior Publication Data

US 2004/0175263 A1 Sep. 9, 2004

(51) Int. Cl.
*F01D 11/00* (2006.01)

(52) U.S. Cl. ..... 415/174.2; 415/231; 277/642; 277/647

(58) Field of Classification Search ..... 415/100, 415/101, 103, 174.5, 174.2, 170.1, 230, 231; 277/641, 642, 647
See application file for complete search history.

(56) References Cited

U.S. PATENT DOCUMENTS 1,625,541 A * 4/1927 Hodgkinson ..... 415/136
3,942,804 A 3/1976 Andress et al.
5,076,591 A 12/1991 Gentile
5,249,814 A * 10/1993 Halling ..... 277/654
5,253,875 A 10/1993 Gentile
5,355,909 A 10/1994 Smith, III
5,411,365 A * 5/1995 Mazzola et al. ..... 415/93
6,286,840 B1 9/2001 Zettel
6,349,467 B1 2/2002 Karafillis et al.
6,352,267 B1 * 3/2002 Rode ..... 277/631
6,446,978 B1 * 9/2002 Halling et al. ..... 277/626

* cited by examiner

*Primary Examiner*—Edward K. Look
*Assistant Examiner*—Dwayne J. White
(74) *Attorney, Agent, or Firm*—Armstrong Teasdale LLP

(57) ABSTRACT

A method and apparatus for assembling a steam turbine is provided. The method includes performing a finite element analysis to determine a cross-section of a sealing member, positioning the sealing member in a leakage path defined between an inner casing and an outer casing such that a leakage flow activates the sealing member. The apparatus includes a groove defined in a channel, a divider positioned in the channel such that a gap defined between the divider and the channel defines a leakage path, and a sealing member that extends at least partially within the groove and positioned to substantially prevent a flow though the leakage path.

15 Claims, 4 Drawing Sheets

METHOD AND APPARATUS FOR ROTATING MACHINE MAIN FIT SEAL

BACKGROUND OF INVENTION

This invention relates generally to steam turbines, and more particularly, to controlling steam leakage paths in the turbine.

A steam turbine may include a high-pressure (HP) turbine section, an intermediate-pressure (IP) turbine section, and a low-pressure (LP) turbine section that each include rotatable steam-turbine blades fixedly attached to, and radially extending from, a steam-turbine shaft that is rotatably supported by bearings. The bearings may be located longitudinally outwardly from the high and intermediate-pressure turbine sections. A steam pressure drop through at least some known high-pressure and/or intermediate-pressure turbine sections is at least about 2,000 kPa (kiloPascals), and a difference in pressure of the steam entering the high and intermediate-pressure turbine sections is at least about 600 kPa. In some known steam turbines, steam exiting the HP turbine section is reheated by a boiler before entering the IP turbine section.

A steam turbine has a defined steam path which includes, in serial-flow relationship, a steam inlet, a turbine, and a steam outlet. Steam leakage, either out of the steam path, or into the steam path, from an area of higher pressure to an area of lower pressure, may adversely affect an operating efficiency of the turbine. For example, steam-path leakage in the turbine between a rotating rotor shaft of the turbine and a circumferentially surrounding turbine casing, may lower the efficiency of the turbine leading to increased fuel costs. Additionally, steam-path leakage between a shell and the portion of the casing extending between adjacent turbines, for example, a high pressure turbine section to an adjacent intermediate turbine section, may lower the operating efficiency of the steam turbine and over time, may lead to increased fuel costs.

To facilitate minimizing steam-path leakage between the HP turbine section and a longitudinally-outward bearing, and/or between the IP turbine section and a longitudinally-outward bearing, at least some known steam turbines use a plurality of labyrinth seals. Such labyrinth seals include longitudinally spaced-apart rows of seal teeth. Many rows of seal teeth facilitate providing a seal against the high-pressure differentials that may be in a steam turbine. Brush seals may also be used to minimize leakage through a gap defined between two components, and/or leakage from a higher pressure area to a lower pressure area. Although, brush seals provide a more efficient seal than labyrinth seals, at least some known steam turbines, that use a brush seal assembly between turbine sections and/or between a turbine section and a bearing, also use at least one standard labyrinth seal as a redundant backup seal for the brush seal assembly.

Other areas of steam path leakage may adversely affect turbine efficiency. One such area is a main-fit of casing packing head between the HP turbine section and the IP section where the use of labyrinth and brush seals is impractical due to high pressure and large mechanical deflections in the fit area.

SUMMARY OF INVENTION

In one aspect, a method of assembling a steam turbine is provided. The method includes performing a finite element analysis to determine a cross-section of a sealing member, and positioning the sealing member in a leakage path defined between an inner casing and an outer casing such that a leakage flow activates the sealing member.

In another aspect of the invention, a seal is provided. The seal includes a groove defined in a channel, a divider positioned in the channel such that a gap defined between the divider and the channel defines a leakage path, and a sealing member that extends at least partially within the groove and is positioned to substantially prevent a flow through the leakage path.

In yet another aspect, a rotary machine is provided. The machine includes a rotor that is rotatable about a longitudinal axis and the rotor includes an outer annular surface, an annular outer casing including an inner surface, wherein the outer casing is spaced radially outwardly from the rotor, and the casing inner surface includes a first extension extending radially inwardly towards the rotor. The first extension extends substantially circumferentially about the casing inner surface, and the machine also includes a cylindrical inner casing including an outer surface, that includes a second extension extending radially towards the outer casing, wherein the second extension extends substantially circumferentially about the outer surface, and the second extension includes a channel formed in an outer extension surface for receiving the first extension when the outer casing and the inner casing are assembled. The machine also includes a groove formed in the channel and sized to receive a sealing member, and a sealing member that is positioned at least partially within the groove for sealing a leakage path.

DETAILED DESCRIPTION

Figure 1:
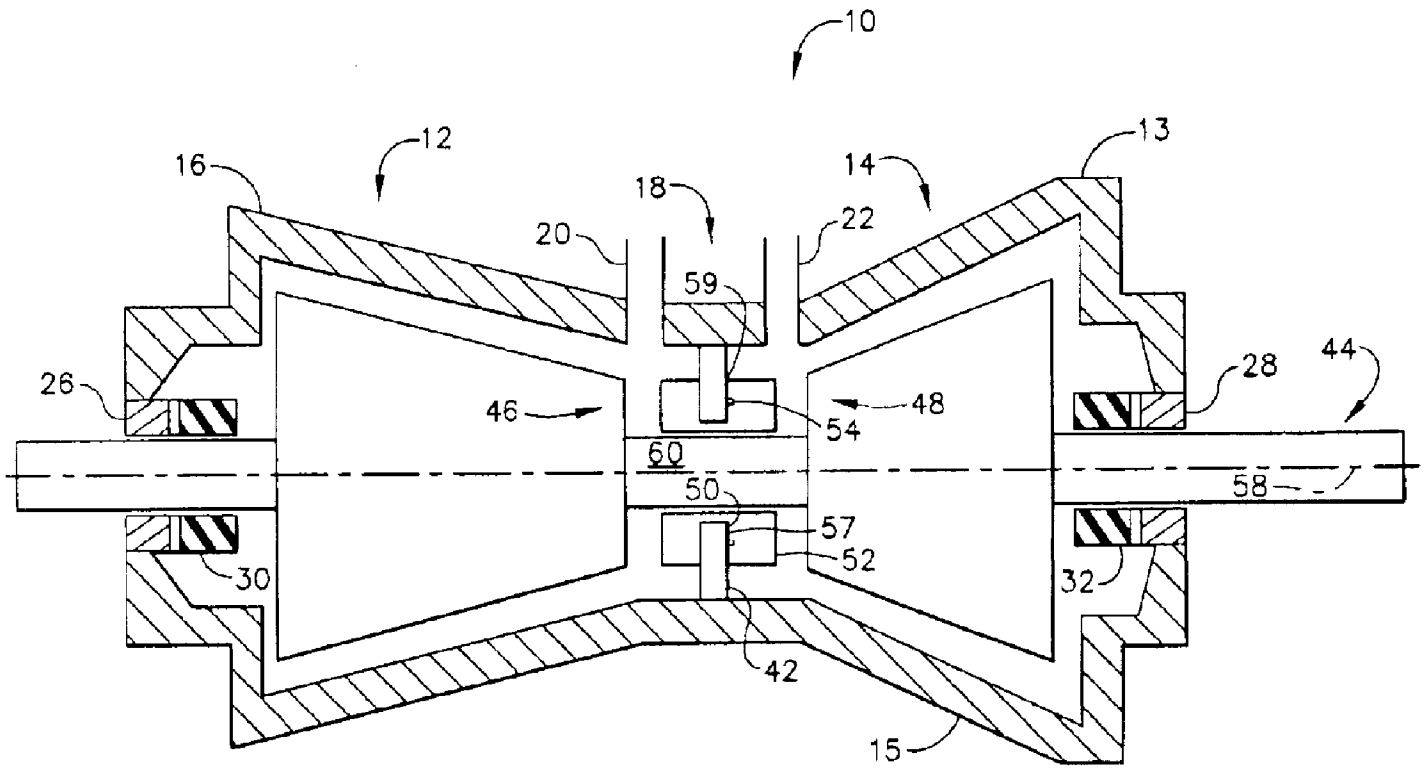
FIG. 1 is a schematic illustration of an exemplary opposed flow HP/IP steam turbine.

FIG. 1 is a schematic illustration of an exemplary opposed-flow steam turbine 10 including a high pressure (HP) section 12 and an intermediate pressure (IP) section 14. A single outer shell or casing 16 is divided axially into upper and lower half sections 13 and 15, respectively, and spans both HP section 12 and IP section 14. A central section 18 of shell 16 includes a high pressure steam inlet 20 and an intermediate pressure steam inlet 22. Within outer shell or casing 16, HP section 12 and IP section 14 are arranged in a single bearing span supported by journal bearings 26 and 28. A steam seal unit 30 and 32 is located inboard each journal bearing 26 and 28, respectively.

An annular section divider 42 extends radially inwardly from central section 18 and towards a rotor shaft 44 extending between HP section 12 and IP section 14. More specifically, divider 42 extends circumferentially around a portion of shaft 44 extending between first HP section nozzle 46 and a first IP section nozzle 48. Section divider 42 is received in a channel 50 formed in packing casing 52. Channel 50 is a C-shaped channel that extends radially into packing casing 52 and around an outer circumference of packing casing 52, such that a center opening of channel 50 faces radially outwardly. Channel 50 includes a seal groove 54 positioned in a radially extending surface 57 of channel 50. Seal groove 54 is co-axial about a longitudinal axis 58 of turbine 10. In an alternative embodiment, section divider 42 includes a seal groove 54 positioned in a radially extending surface 59 of section divider 42.

In operation, high pressure steam inlet 20 receives high pressure/high temperature steam from a source, for example, a power boiler (not shown). The steam is routed through HP section 12 wherein work is extracted from the steam to rotate rotor shaft 44. The steam exits HP section 12 and returns to the boiler where it is reheated. The reheated steam is then routed to intermediate pressure steam inlet 22 and returned to IP section 14 at a reduced pressure than steam entering HP section 12, but at a temperature that is substantially similar to the steam entering HP section 12. Accordingly, an operating pressure within HP section 12 is higher than an operating pressure in IP section 14. Therefore, steam within HP section 12 tends to flow towards IP section 14 through leakage paths that may develop between HP section 12 and IP section 14. One such leakage path may be defined along a rotor 44 extending through packing casing 52. Accordingly, packing casing 52 includes a plurality of labyrinth and/or brush seals to facilitate reducing leakage from HP section 12 to IP section 14 along a shaft 60. Another leakage path between HP section 12 and IP section 14 is through a gap between section divider 42 and packing casing 52 in channel 50.

Figure 2:
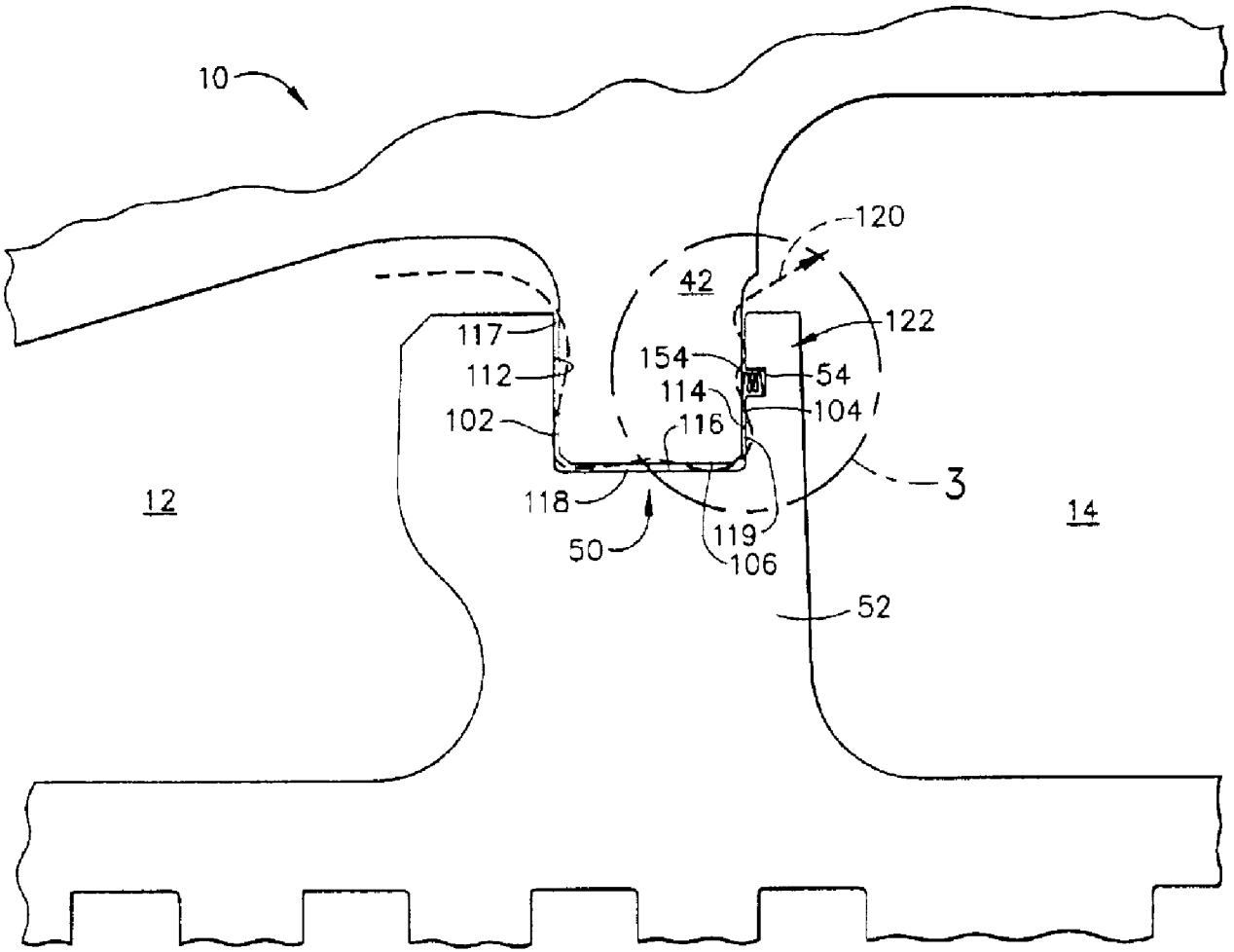
FIG. 2 is an enlarged schematic illustration of a section divider and mating channel that may be included in the steam turbine shown in FIG. 1.

FIG. 2 is an enlarged schematic illustration of a section divider 42 and channel 50 that may be included in steam turbine 10. Section divider 42 includes a first side 102, a sealing side 104, and a joining side 106. Channel 50 includes a first side 112, a sealing side 114, and a joining side 116. Sides 102 and 112 of section divider 42 and channel 50, respectively, correspond with each other in a mating fashion when section divider 42 and channel 50 are coupled. Sealing sides 104 and 114, and joining sides 106 and 116, similarly mate together when section divider 42 and channel 50 are coupled. Since sides 102, 104, and 106 do not mate exactly to sides 112, 114, and 116, a plurality of gaps 117, 118, and 119 are formed between corresponding sides, 102 and 112, 106 and 116, and 104 and 114, respectively. More specifically, each gap 117, 118, and 119 forms a potential steam flow leakage path 120 from HP section 12 towards IP section 14.

A groove 54 is formed in seal side 114, and is sized to receive a sealing member 154, therein. More specifically, seal assembly 122 includes member 154, and is a pressure activated sealing member that is configured such that a pressure being sealed provides a motive force to cause the sealing member to seal tighter as pressure applied to the sealing member increases. In one embodiment, sealing member 154 has a V-shaped cross-sectional profile. In another embodiment, sealing member 154 has, but is not limited to, a W-shaped cross-section, a U-shaped cross-section, or a compound-convoluted cross-section. At least some known seals are not appropriate for this application because of a high pressure differential across section divider 42 and a large physical motion between section divider 42 and channel 50 that cause gaps 117, 118, and 119 to change in a width dimension when conditions in turbine 10 vary. In the exemplary embodiment, sealing member 154 has a high spring rate and high compliance, and the final configuration is a resilient metallic seal, which has been optimized through parametric finite element modeling analysis (FEA). Sealing member 154 cross-section may be determined through FEA to optimize an internal stress of sealing member 154 to facilitate providing a long sealing life, and to optimize a spring rate to facilitate maximizing sealing effectiveness. In one embodiment, sealing member is segmented, or non-contiguous, to facilitate assembly of turbine 10. Specifically, sealing member 154 may include two, or four, or more segments depending on a manufacturing complexity, which increases with the number of segments, and an ease of assembly which decreases with an increasing number of segments.

In operation, steam at higher pressure in HP section 12 tends to leak through steam path 120 towards IP section 14, which is at a lower steam pressure. Sealing member 154 seated in groove 54, activates to facilitate limiting or stopping steam leakage flow through leakage path 120.

Figure 3:
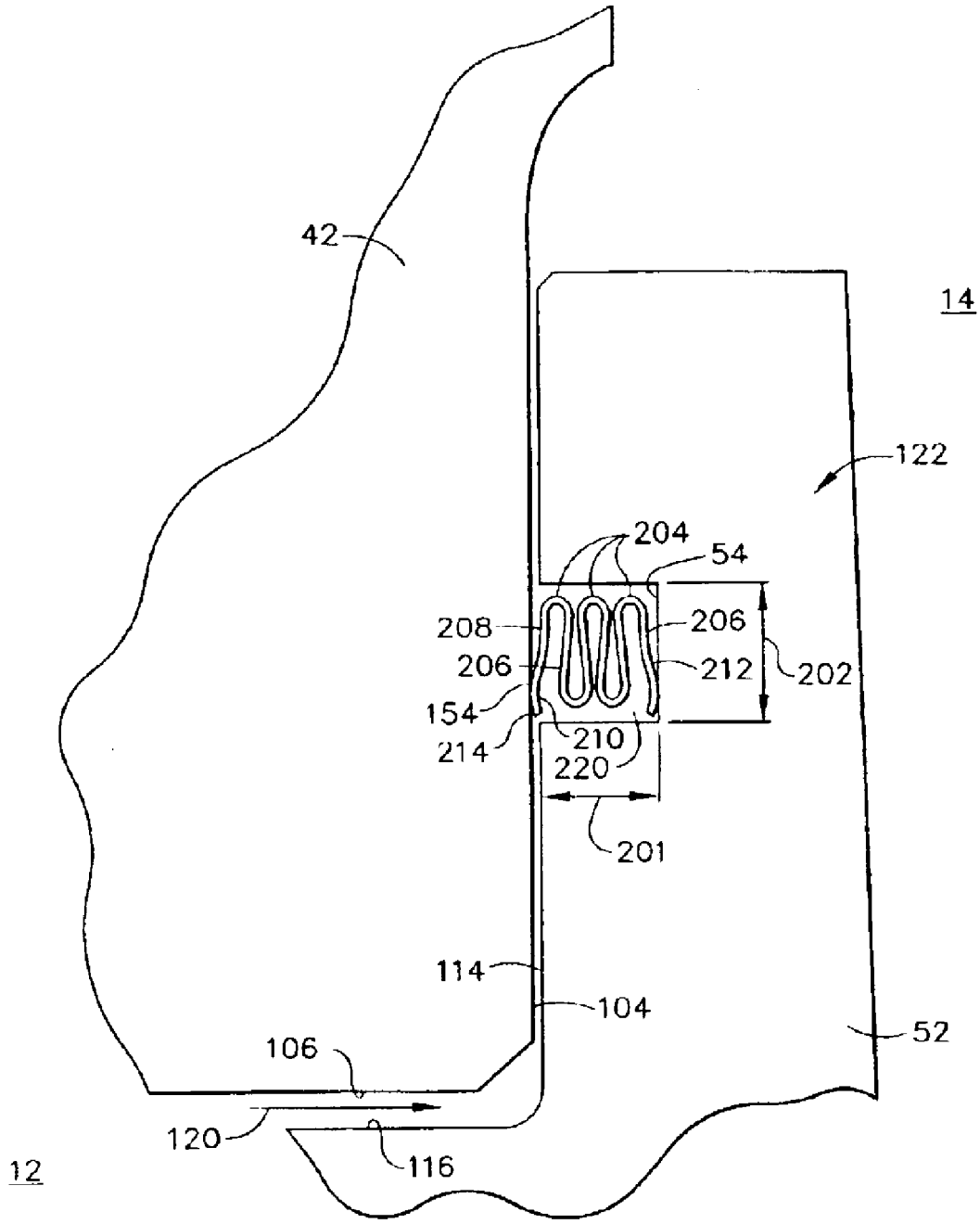
FIG. 3 is an enlarged view of the section divider shown in FIG. 1 and taken along area 3.

FIG. 3 is an enlarged view of section divider 42 taken along area 3. More specifically, FIG. 3 is an enlarged view of seal assembly 122. Section divider 42 is coupled to packing casing 52 such that corresponding sides 106 and 116 are proximate each other, and corresponding sides 104 and 114 are proximate each other. Gaps 19 and 118 are defined between sides 104 and 114, and between sides 106 and 116, respectively. Gaps 119 and 118 permit steam from HP section 12 to leak toward IP section 14 through leakage path 120 during operation of turbine 10. To facilitate reducing or eliminating steam leakage through leakage path 120, sealing member 154 is positioned in groove 54 in side 114. Seal groove 54 is defined by a groove depth 201 and a groove width 202. In the exemplary embodiment, each groove depth 201 and groove width 202 are between approximately 0.2 inches and approximately 0.5 inches. In the exemplary embodiment, sealing member 154 is a compound-convoluted seal. More specifically, sealing member 154 has a cross-sectional profile that includes a plurality of apexes 204 that are joined by a pair of opposed legs 206 and 208 that each diverge from apex 204. Legs 206 and 208 form a respective interior surface 210 and an exterior surface 212. Sealing member 154 is sized such that at least a portion of leg 208 extends past side 114 into leakage path 120, and such that when section divider 42 and channel 50 are coupled, leg 208 at least partially engages side 104.

Sealing member 154 is fabricated from a material that provides flexibility at apex 204 and rigidity of legs 206 and 208 to withstand a pressure differential across legs 206 and 208. In the exemplary embodiment, sealing member 154 can withstand a pressure differential of at least approximately 600 kPa. In the exemplary embodiment, sealing member 154 is fabricated from rolled sheet metal having a thickness of between about 0.005 inches and 0.030 inches. In other embodiments, sealing member 154 is fabricated from a material such as, but not limited to, for example, Hastelloy®, Cres 304, and Incoloy 909®. Sealing member 154 is positioned in groove 54 such that leg 208 engages side 104 with interior surface 210 facing the direction of leakage flow 120.

In operation, steam from HP section 12 attempts to flow to lower pressure IP section 12 during normal operation of turbine 10. As steam flows through leakage path 120, the steam contacts sealing member interior surface 210. Leg exterior surface 212 contacts side 104 due to the flexibility of apex 204 and thus provides a bias to leg 208. A distal end 214 of leg 208 blocks steam flow from leakage path 120 and directs the steam towards an area 220 defined within interior surface 210 of sealing member 154. A differential pressure builds up across sealing member 154 due to steam from HP section 12 becoming trapped in area 220 and leakage path 120 downstream of sealing member 154 still being in communication with IP section 14. The differential pressure across sealing member 154 causes legs 206 and 208 to expand outwardly further tightening the contact between exterior surface 212 of sealing member 154 and side 104.

Figure 4:
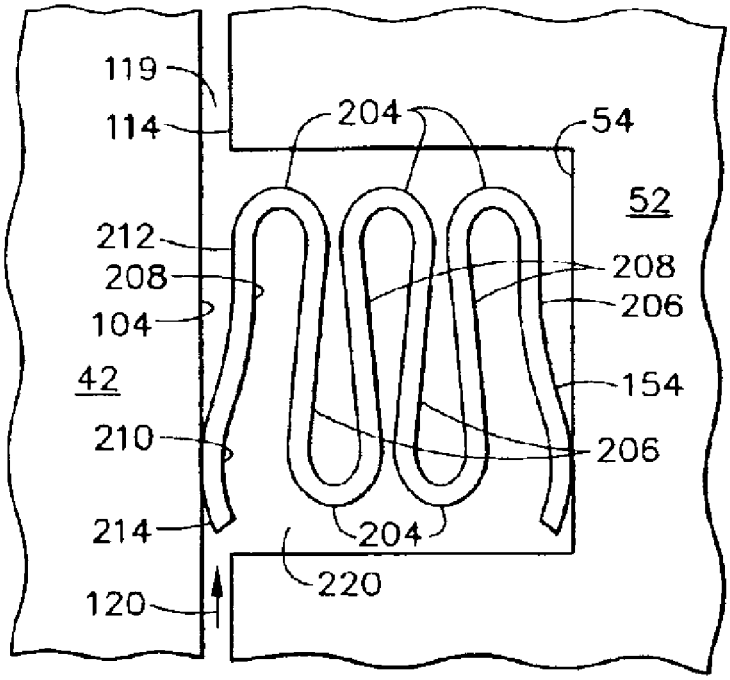
FIG. 4 is an exemplary embodiment of a sealing member that may be used with the sealing assembly shown in FIG. 3.

FIG. 4 is a cross-sectional schematic view of an exemplary embodiment of a sealing member 402 that may be used in seal assembly 122 shown in FIG. 3. Components in FIG. 4 that are identical to components shown in FIG. 3 are referenced using the same reference numerals used in FIG. 3. Accordingly, seal assembly 122 includes groove 54 formed in packing casing 52. In one embodiment, groove 54 may be formed in section divider 42. Sealing member 154 is positioned in groove 54 and sealing member 154 includes a plurality of apexes 204 that are each joined by a pair of opposed legs 206 and 208 that each diverge from each apex 204. Legs 206 and 208 form an interior surface 210 and an exterior surface 212. Sealing member 154 is sized such that at least a portion of leg 208 extends past side 114 into leakage path 120 such that when section divider 42 and channel 50 are coupled, leg 208 at least partially engages side 104.

In operation, steam from HP section 12 attempts to flow to lower pressure IP section 12 during normal operation of turbine 10. As steam flows through leakage path 120, the steam contacts sealing member interior surface 210, and leg exterior surface 212 contacts side 104 due to the flexibility of apex 204, and thus provides a bias to leg 208. A distal end 214 of leg 208 blocks steam flow from leakage path 120 and directs the steam towards an area 220 defined within interior surface 210 of sealing member 154. A differential pressure builds up across sealing member 154 due to steam from HP section 12 becoming trapped in area 220 and leakage path 120 downstream of sealing member 154 still being in communication with IP section 14. The differential pressure across sealing member 154 causes legs 206 and 208 to expand outwardly further tightening the contact between exterior surface 212 of sealing member 154 and side 104.

Figure 5:
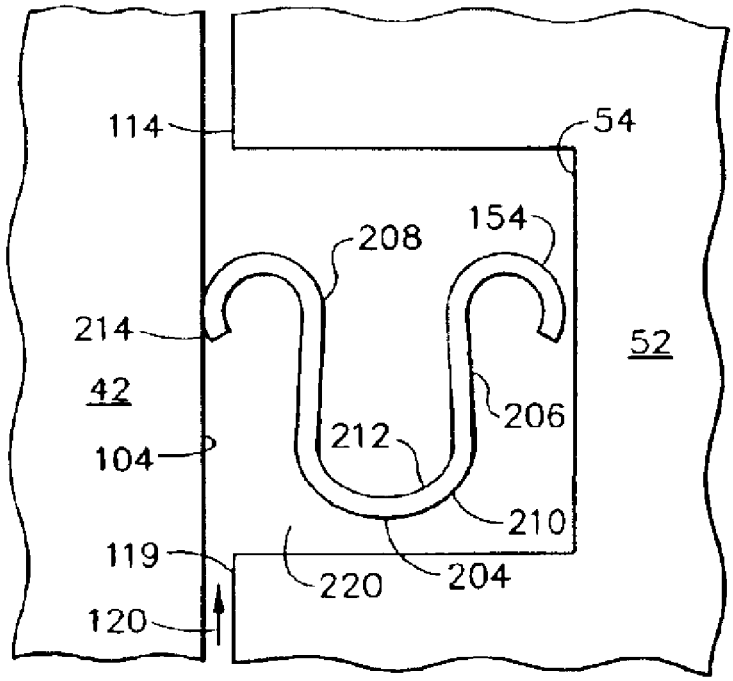
FIG. 5 is an alternative embodiment of a sealing member that may be used with the sealing assembly shown in FIG. 3.

FIG. 5 is a cross-sectional schematic view of an alternative embodiment of an exemplary sealing member 502 that may be used in seal assembly 122 shown in FIG. 3. Components in FIG. 5 that are identical to components shown in FIG. 3 are referenced using the same reference numerals used in FIG. 3. Accordingly, seal assembly 122 includes groove 54 formed in packing casing 52. In one embodiment, groove 54 may be formed in section divider 42. Sealing member 154 is positioned in groove 54 and sealing member 154 includes an apex 204, joined by a pair of opposed legs 206 and 208 that each diverge from apex 204. Legs 206 and 208 form an interior surface 210 and an exterior surface 212. Sealing member 154 is sized such that at least a portion of leg 208 extends past side 114 into leakage path 120 such that when section divider 42 and channel 50 are coupled, leg 208 at least partially engages side 104.

In operation, steam from HP section 12 attempts to flow to lower pressure IP section 12 during normal operation of turbine 10. As steam flows through leakage path 120, the steam contacts sealing member interior surface 210. Leg exterior surface 212 contacts side 104 due to the flexibility of apex 204 and thus provides a bias to leg 208. A distal end 214 of leg 208 blocks steam flow from leakage path 120 and directs the steam towards an area 220 defined within interior surface 210 of sealing member 154. A differential pressure builds up across sealing member 154 due to steam from HP section 12 becoming trapped in area 220 and leakage path 120 downstream of sealing member 154 still being in communication with IP section 14. The differential pressure across sealing member 154 causes legs 206 and 208 to expand outwardly further tightening the contact between exterior surface 212 of sealing member 154 and side 104.

The above-described turbine casing seal arrangement is cost effective and highly reliable. The seal arrangement includes a sealing member designed using finite element analysis to facilitate optimizing a cross-section of the sealing member to facilitate reducing steam leakage through an internal leakage path in the turbine. As a result, the turbine casing seal arrangement facilitates reducing steam leakage in a turbine in a cost effective and reliable manner.

Exemplary embodiments of turbine casing seal arrangements are described above in detail. The arrangements are not limited to the specific embodiments described herein, but rather, components of the system may be utilized independently and separately from other components described herein. Each turbine casing seal arrangement component can also be used in combination with other turbine casing seal arrangement components.

While the invention has been described in terms of various specific embodiments, those skilled in the art will recognize that the invention can be practiced with modification within the spirit and scope of the claims.

What is claimed is:

1. A method of assembling a steam turbine, said method comprising:

performing a finite element analysis to determine a cross-section of a sealing member; and positioning the sealing member in a leakage path defined between an inner casing and an outer casing such that a leakage flow activates the sealing member such that the leakage path is substantially sealed by the sealing member and such that the sealing member is slideably engaged with a divider positioned in the leakage path.

2. A method in accordance with claim 1 wherein performing a finite element analysis further comprises performing a finite element analysis to determine a resilience of the sealing member.

3. A method in accordance with claim 1 wherein performing a finite element analysis further comprises performing a finite element analysis to facilitate optimizing an internal stress of the sealing member.

4. A method in accordance with claim 1 wherein performing a finite element analysis further comprises performing a finite element analysis to facilitate maximizing a spring rate of the sealing member.

5. A method in accordance with claim 1 wherein positioning the sealing member comprises positioning the sealing member in a groove formed in one of a channel defined in the inner casing and an extension of the outer casing that extends into the channel.

6. A method in accordance with claim 5 wherein positioning a sealing member comprises positioning the sealing member such that a leakage path defined between the inner casing and the Outer casing is at least partially obstructed.

7. A method in accordance with claim 5 wherein positioning a sealing member comprises positioning the sealing member such that flow through the leakage path facilitates enhanced sealing.

8. A seal assembly for sealing a leakage path, said seal assembly comprising:

a groove defined in a channel;

a divider positioned in said channel such that a gap defined between said divider and said channel defines a leakage path; and a sealing member extending at least partially within said groove, said sealing member configured to slideably engage said divider and positioned to substantially prevent a flow through said leakage path, said sealing member comprises a plurality of circumferential segments wherein at least two of said segments comprise substantially semi-circular portions.

9. A seal assembly in accordance with claim 8 wherein said leakage path is defined between adjacent turbine sections of a turbine engine.

10. A seal assembly in accordance with claim 8 wherein said channel is formed in a circumferential extension of a turbine inner casing.

11. A rotary machine comprising:

a rotor rotatable about a longitudinal axis, said rotor comprising an outer annular surface;

an annular outer casing comprising an inner surface, said outer casing spaced radially outwardly from said rotor, said casing inner surface comprising a first extension extending radially inwardly towards said rotor, said first extension extending substantially circumferentially about said casing inner surface;

a cylindrical inner casing comprising an outer surface, said outer surface comprising a second extension extending radially towards said outer casing, said second extension extending substantially circumferentially about said outer surface, said second extension comprising a channel formed in an outer extension surface for receiving said first extension when said outer casing and said inner casing are assembled;

a groove formed in said channel sized to receive a sealing member; and a sealing member positioned at least partially within said groove for sealing a leakage path, said sealing member configured to slideably engage said first extension, said groove is sized to receive a sealing member at least partially therein such that said sealing member is configured to flare when subjected to leakage flow such that a sealing capability is facilitated.

12. A rotary machine in accordance with claim 11 wherein said rotor comprises an opposed flow turbine rotor.

13. A rotary machine in accordance with claim 11 wherein said leakage path is defined between a high pressure (HP) turbine section and intermediate pressure (IP) turbine section of an HP/IP turbine.

14. A rotary machine in accordance with claim 11 wherein said sealing member comprises at least one of a V-seal, a U-seal, a compound convoluted seal, an E-seal, a W-seal, and a C-seal.

15. A rotary machine in accordance with claim 11 wherein said sealing member comprises a plurality of circumferential segments.

* * * * *